US006217682B1

(12) United States Patent
Campbell

(10) Patent No.: US 6,217,682 B1
(45) **Date of Patent: *Apr. 17, 2001**

(54) ENERGETIC OXETANE PROPELLANTS

(75) Inventor: Carol Jean Campbell, Ogden, UT (US)

(73) Assignee: Cordant Technologies Inc., Salt Lake City, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/178,608

(22) Filed: Oct. 26, 1998

Related U.S. Application Data

(60) Provisional application No. 60/063,071, filed on Oct. 27, 1997.

(51) Int. Cl.[7] ..... C06B 45/10

(52) U.S. Cl. ..... 149/19.6; 149/19.4; 149/44; 149/113; 60/219; 60/76

(58) Field of Search ..... 149/37, 76, 113, 149/19.4; 60/219, 76

(56) References Cited

U.S. PATENT DOCUMENTS

| | | | |
|---|---|---|---|
| H717 | 12/1989 | Stephens et al. | 149/19.2 |
| 2,293,868 | 8/1942 | Toussaint | 260/338 |
| 2,327,053 | 8/1943 | Marple et al. | 260/166 |
| 2,380,185 | 7/1945 | Marple et al. | 260/615 |
| 2,723,294 | 11/1955 | Benoit | 260/615 |
| 3,042,666 | 7/1962 | Gentles | 260/209 |
| 3,324,108 | 6/1967 | Molleer et al. | 260/209 |
| 3,359,217 | 12/1967 | Brandner | 260/2.5 |
| 3,417,034 | 12/1968 | Hoy | 260/2 |
| 3,954,884 | 5/1976 | Kidwell | 260/615 R |

(List continued on next page.)

FOREIGN PATENT DOCUMENTS

| | | |
|---|---|---|
| 27 18 013 | 11/1977 | (DE) . |
| 2 232 523 | 1/1975 | (FR) . |
| 95/09824 | 4/1995 | (WO) . |

OTHER PUBLICATIONS

Chemical Abstracts, vol. 119, No. 12, Sep. 20, 1993, Abstract No. 120692z, Y. Oyumi et al.: "Thermal decomposition of AMMO/AP composite propellants" p. 210; XP000372261, see abstract & Propellants, Explos., Pyrotech., vol. 18, No. 3, 1993, pp. 168–172.

Chemical Abstracts, vol. 125, No. 18, Oct. 28, 1996, Abstract No. 225917d, E. Kimura et al.: "Insensitive munitions and combustion characteristics of BAMO/NMMO propellants" p. 278; XP000661197, see abstract & J. Energ. Mater., vol. 14, No. 3,4, 1996, pp. 201–215.

Chemical Abstracts, vol. 124, No. 20, May 13, 1996, Abstract No. 264989c, E. Kimura et al.: "IM characteristics of BAMO/NMMO composite propellants" p. 233; XP000663713, see abstract & Kayaku Gakkaishi, vol. 57, No. 1, pp. 14–20.

Cohen, N. "Combustion Chemistry Of Nitrate Ester–Based Propellants", 1983 AIAA/SAE/ASME 19$^{th}$ Joint Propulsion Conference, pp. 1–7. (1983).

(List continued on next page.)

*Primary Examiner*—Charles T. Jordan
*Assistant Examiner*—Aileen J. Baker
(74) *Attorney, Agent, or Firm*—Pillsbury Madison & Sutro Intellectual Property Group

(57) ABSTRACT

An energetic solid rocket motor propellant having one or more plateau regions of low operating pressure exponent is disclosed. The propellant is formulated from ingredients including an energetic polyoxetane, an effective amount of a plasticizer, an inorganic oxidizer in at least two discrete particle size ranges, and a refractory oxide burn rate modifier.

20 Claims, 5 Drawing Sheets

U.S. PATENT DOCUMENTS

| | | | | |
|---|---|---|---|---|
| 3,986,910 | | 10/1976 | McCulloch et al. . | |
| 4,112,231 | | 9/1978 | Weibull et al. | 544/174 |
| 4,282,387 | | 8/1981 | Olstowski et al. | 568/618 |
| 4,359,589 | | 11/1982 | Brownscombe | 568/618 |
| 4,405,497 | | 9/1983 | Young et al. | 252/431 R |
| 4,477,589 | | 10/1984 | van der Hulst et al. | 502/169 |
| 4,481,123 | | 11/1984 | Hentschel et al. | 252/52 R |
| 4,707,540 | | 11/1987 | Manser et al. | 528/417 |
| 4,879,419 | | 11/1989 | Johannessen | 568/606 |
| 4,915,755 | | 4/1990 | Kim | 149/19.4 |
| 4,988,797 | | 1/1991 | Wardle et al. | 528/408 |
| 5,124,463 | | 6/1992 | Ampleman | 552/11 |
| 5,210,153 | | 5/1993 | Manser et al. . | |
| 5,210,179 | | 5/1993 | Stewart | 528/408 |
| 5,214,110 | | 5/1993 | Ahad | 525/403 |
| 5,334,270 | * | 8/1994 | Taylor, Jr. | 149/19.4 |
| 5,498,303 | * | 3/1996 | Hinshaw et al. | 149/19.6 |
| 5,579,634 | * | 12/1996 | Taylor, Jr. | 60/219 |
| 5,741,998 | * | 4/1998 | Hinshaw et al. | 149/19.6 |
| 5,771,679 | * | 6/1998 | Taylor, Jr. et al. | 60/219 |

OTHER PUBLICATIONS

G. Lengelle et al. "Steady–State Burning of Homogeneous Propellants", pp. 361–409. Fundamentals of Solid Propellant Combustion, vol. 90 (1984).

Hinshaw, C.J. et al., "Achievement of Plateau Ballistics in AP/HTPB Propellants," JANNAF Combustion Subcommittee Meeting, pp. 343–358 (Oct. 1995).

Hinshaw, C.F. et al., "Development and Demonstrastion of Aluminized AP/HTPB Propellants Having Plateau and Biplateau Ballistics," 1995 JANNAF Propulsion Meeting, pp. 193–208 (Dec. 1995).

Cohen, N. "Literature Review of Plateasu Ballistics in Non–Aluminized Solid Propellants," 1990 JANNAF Propulsion Meeting, pp. 387–410.

Cohen, N. "Explanation for Anomalous Combustion Behavior in Composite Propellants," 29th JANNAF Subcommittee Meeting, pp. 253–273 (Oct. 1992).

* cited by examiner

| Mix | Pc Range, psi | Rb Range, ips | n |
|---|---|---|---|
| 94-1 | 1300-2500 | 1.46-1.06 | -0.49 |
| 12-2 | 1900-3200 | 0.82-0.72 | -0.26 |
| 17-2 | 2100-4700 | 0.96-0.98 | 0.02 |

ENERGETIC OXETANE PROPELLANTS

This application claims priority of provisional application 60/063,071 filed in the U.S. Patent & Trademark on Oct. 27, 1997, the complete disclosure of which is incorporated herein by reference.

BACKGROUND OF THE INVENTION

1. Field of the Invention

The present invention relates to selected propellant formulations based on energetic oxetane binder systems exhibiting low, zero or negative pressure exponents across a pressure region, e.g., plateau ballistic behavior.

2. Background Information

Solid propellants are used extensively in the aerospace industry. Solid propellants have developed as the preferred method of powering most missiles and rockets for military, commercial, and space applications. Solid rocket motor propellants have become widely accepted because of the fact that the propellants are relatively simple to formulate and use and have excellent performance characteristics. Furthermore, solid propellant rocket motors are generally very simple when compared to liquid fuel rocket motors. For all of these reasons, it is found that solid rocket propellants are often preferred over other alternatives, such as liquid propellant rocket motors.

Typical solid rocket motor propellants are generally formulated having an oxidizing agent, a fuel, and a binder. At times, the binder and the fuel may be the same. In addition to the basic components set forth above, it is conventional to add various plasticizers, curing agents, cure catalysts, and other similar materials which aid in the processing and curing of the propellant. A significant body of technology has developed related solely to the processing and curing of solid propellants, and this technology is well known to those skilled in the art.

One type of propellant that is widely used incorporates ammonium perchlorate ("AP") as the oxidizer. The AP oxidizer may then, for example, be incorporated into a propellant which is bound together by a hydroxy-terminated polybutadiene (HTPB) binder. These HTPB binders are widely used and commercially available. It has been found that such propellant compositions provide ease in manufacting and handling; exhibit good performance characteristics; and are at the same time economical and reliable. In essence, it can be said that AP composite propellants have been the backbone of the solid propulsion industry for approximately the past 40 years.

One of the problems encountered in the design of rocket motors is the control of the thrust output of the rocket motor. This is particularly true when it is desired to operate the motor in two or more different operational modes. For example, it is often necessary to provide a high level of launch-phase thrust in order to "boost" the motor and its attached payload from a starting position, such as during launch of a rocket or missile. Once the launch phase has been completed, it may be desirable to provide a constant output from the rocket motor over an extended "sustain" operation. This sustain may occur, for example, after the rocket has been placed in flight and while it is traveling to its intended destination.

The achievement of such multi-phased or biplateau operations has been extremely difficult. It has been necessary to resort to complex mechanical arrangements in the rocket motors. Alternatively, less efficient and less desirable liquid rocket motors have been used to obtain multi-phase operation.

In some cases, multiple-phase or biplateau operation has been attempted by constructing very complex propellant grains, such as grains having multiple propellants. In any case, achievement of multiple-phase operation has been complex, time consuming, and costly.

Single plateau propellant offers reduced temperature sensitivity, allows high pressure operation, and a higher expansion ratio for increased performance without affecting motor safety margins. Plateau propellant in general reduces margins required between the maximum expected operating pressure (MEOP) and the maximum nominal pressure. This in turn reduces motor case inert weight and makes high pressure motor operations advantageous.

Still further efforts have focused on non-energetic binder systems in an effort to develop plateau propellants. While offering some advantages, the art is still seeking IM propellants having a higher delivered impulse at lower solids loadings.

SUMMARY AND OBJECTS OF THE INVENTION

The formulation of the present invention provides the capability of achieving one or more regions of low pressure exponent with a propellant based on an energetic oxetane binder, such as, for instance, poly (nitratomethylmethyloxetane) ("NMMO") poly (azidomethyl methyloxetane) ("AMMO"), and poly (bisazidomethyloxetane) copoly(azidomethyl methyloxetane) ("BAMO-AMMO"), which is plasticized with a plasticizing amount of, for instance, triethylethylene glycol dinitrate ("TEGDN"), glycidylazide plasticizer ("GAP"), or butyl (nitratomethyl) nitramine ("BuNENA").

The ballistic plateau characteristics of the present propellant formulations are combined with the advantages of an energetic oxetane binder system. The present propellant formulations permit the propellant formulator to prepare propellant with energy partitioning between the binder and solids for IM improvement, reduced ESD sensitivity, and reduced solids loading. The use of energetic binders can be in the form of thermoplastic elastomers ("TPE"), verses conventionally chemically cured binders, which leads to still further advantages in processing and recycling.

The present formulations consequently offer a significant improvement over the existing art. The present formulations simplify and lower the cost of boost-sustain and sustain-boost motor manufacture by requiring only a single propellant. Using the formulations of the present invention, higher volumetric loading with a simple center perforate (CP) grain design for boost-sustain motors is provided. The selected formulations of the present invention are stable at operating pressures of approximately 4000 to 5000 psi. The present invention is applicable to reduced-smoke and also aluminized propellants.

An important ingredient in achieving the stable mono- or bi-plateau characteristics is the addition of an acceptable quantity of a refractory oxide. Such oxides are generally selected from the group consisting of $TiO_2$, $ZrO_2$, $Al_2O_3$, $SnO_2$, and $SiO_2$, and similar materials. These materials function essentially as burn rate modifiers in the propellant formulation and provide the ability to tailor the burn rate achieved by the propellant.

In certain preferred embodiments of the invention, $TiO_2$ is used and it is economical (low cost) and commercially available in large quantities.

For most applications, the preferred refractory oxide content in the propellant will be in the range of from approximately 0.2% to approximately 4.0% by weight. Excellent results have been achieved with refractory oxides added in the range of from approximately 1.0% to approximately 2.0% by weight. It has also been found that a wide range of particle sizes also provide good results. In particular, particles sizes of from approximately 0.4 microns to approximately 0.02 microns perform well, the former for lower burn-rate ranges and the latter for higher burn-rate ranges.

Other ingredients and composition characteristics may be varied in order to obtain specific desired characteristics. For example, variation of secondary factors and ingredients may influence the specific burn rates and pressure ranges of operation. Such factors may, for example, include AP particle size, distribution and content, plasticizer content, the type of cure agent used, and the presence of other trace components.

Accordingly, an object of the present invention is to provide improved propellant formulations which overcome the limitations of the art as set forth above and are capable of managed energy output, higher pressure operations, and increased performance.

It is an object to provide propellant formulations capable of achieving improved performance and mechanical properties while being suitable for insensitive munitions.

It is an object of the present invention to provide propellant formulations which exhibit the desired plateau ballistic characteristics.

It is an object to provide propellant formulations which, upon combustion, exhibit a desired plateau ballistic behavior at even very high pressures, which offers the related advantage of increased propellant performance without compromising rocket motor safety factors.

It is a further object to provide a propellant formulation which is capable of exhibiting low sensitivity of burn rate to changes in temperature (low $^{90}$k).

These and other objects and advantages of the invention will become apparent upon reading the following detailed description and appended claims, and upon reference to the accompanying drawings.

BRIEF DESCRIPTION OF THE FIGURES

In order that the manner in which the above-recited and other advantages and objects of the invention are obtained, the invention is further described with reference to the appended Figures. These Figures depict data as reported, and are not considered limiting the scope of the invention.

DETAILED DESCRIPTION OF THE INVENTION

Figure 1:
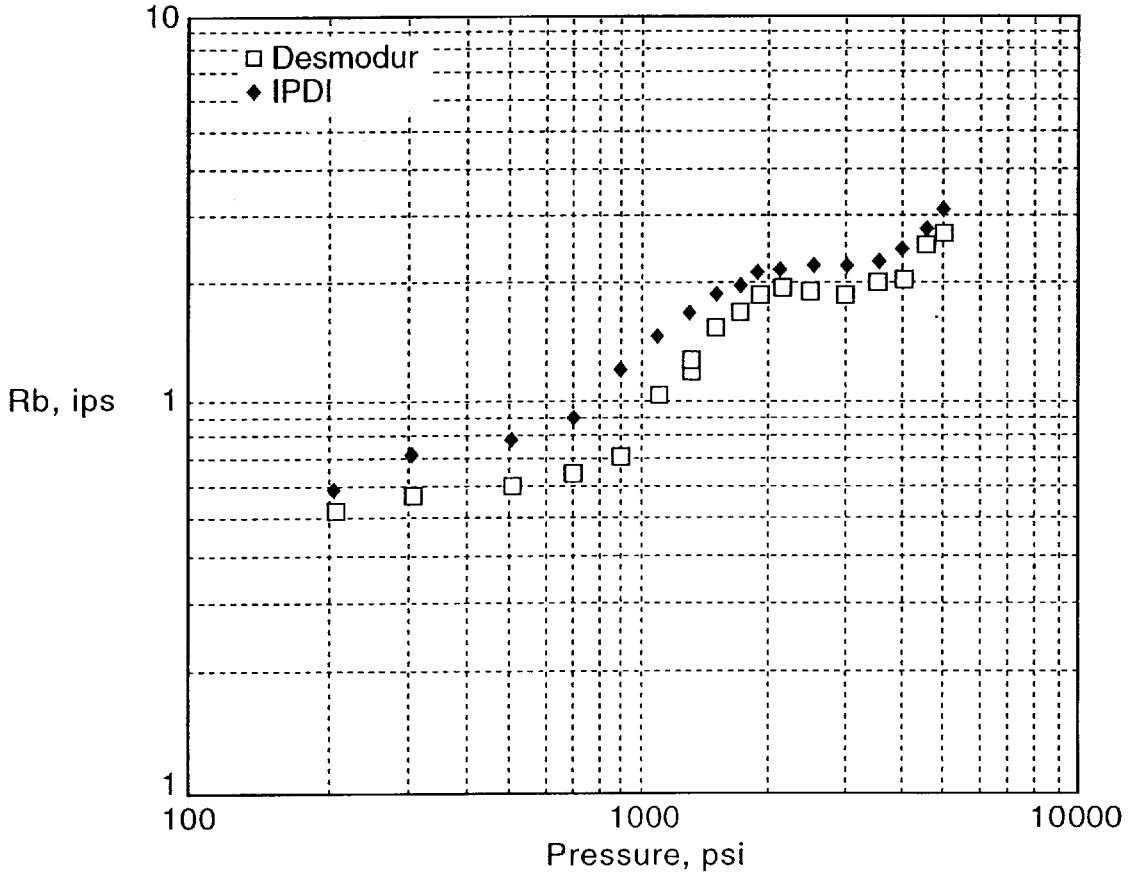
FIG. 1 shows the effect of varying data for a NMMO/TEGDN plateau propellant.

The present formulations generally constitute at lease one energetic oxetane binder, one or more plasticizers in an effective plasticizing amount, an inorganic oxidizer (ammonium perchlorate) in at least two different particle sizes, at least one refractory oxide, and optionally additional additives, curatives, stabilizers and the like. A selected present formulations can, if desired, be a "reduced smoke" formulation or a metallized formulation by including at least one powdered metal fuel.

The energetic oxetane binders suitable for use in the present solid propellant formulations include the nitrato- or azido-substituted oxetanes such as poly-NMMO, poly-AMMO, and poly-BAMO-AMMO. Suitable copolymers and polyoxetanes therefore include poly-DMO (poly-3,3-dimethyal oxetane), poly-EMO (poly-3,3-bis(ethoxymethyl) oxetane), poly-BCMO (poly-3,3-bis(chloromethyl) oxetane), poly-BMMO (poly-3,3-bis(methoxymethyl) oxetane), poly-BFMO (poly-3,3-bis(fluoromethyl)oxetane), poly-HMMO (poly-3-hydroxymethyl-3-methyloxetane), poly-BAOMO (poly-3,3-bis(hydroxymethyl)oxetane), poly-OMMO (poly-3-octoxymethyl-3-methyloxetane), poly-BMEMO (poly-3,3-bis(methoxyethoxymethyl) oxetane), poly-CMMO (poly-3-chloromethyl-3-methyloxetane), poly-AMMO (poly-3-azidomethyl-3-methyloxetane), poly-BIMO (poly-3,3-bis(iodomethyl) oxetane, poly-IMMO (poly-3-iodomethyl-3-methyloxetane), poly-PMMO (poly-3-propynomethylmethyloxetane), poly-BNMO (poly-3,3-bis (nitratomethyl)oxetane), poly-NMMO (poly-3-nitratomethyl-3-methyloxetane), poly-BMNAMO (poly-3,3-bis(methylnitraminomethyl)oxetane), poly-MNAMMO (poly-3-methylnitraminomethyl-3-methyloxetane), and poly-BAMO (poly-3,3-bis(azidomethyl)oxetane).

One or more plasticizers can be suitably used in formulating a selected present propellant composition. Energetic or non-energetic plasticizers can be used, as well as combinations thereof. Suitable energetic plasticizers include nitrate esters, azido plasticizers, and nitrato/nitramino plasticizers. Plasticizers can therefore include nitroglycerin, ethyleneglycol dinitrate, diethyleneglycol dinitrate, triethyleneglycol dinitrate ("TEGDN"), polyethyleneglycol dinitrate, butanetriol trinitrate, trimethylolethane trinitrate, propyleneglycol dinitrate, ethylenediamine dinitrate, n-butyl-2-nitratoethyl-nitramine ("BuNENA"), methyl-2-nitratoethyl-nitramine, ethyl-2-nitratoethyl-nitramine, dinitroxy-diethyl-nitramine, and, for instance, glycidyl azide plasticizer. Exemplary non-energetic plasticizers include such alkyl esters as Triacetin, diethyl suberate ("DESu"), and diethyl sebacate ("DESe"), among others. By present preference, energetic plasticizers are used. The primary oxidizer is ammonium perchlorate ("AP") in a bimodal weight ratio of 200 or 400 $\mu$m coarse to 2, 20 or 50 $\mu$m fine of 60:40 (reduced smoke) to 40:60 (metallized), preferably 53:47 (reduced smoke) and about 45:55 (metalized).

The formulation can, if desired, include additives. A particularly useful additive comprises a ballistic modifier, such as $TiO_2$. The amount used is generally characterized as a small effective ballistically modifying amount. Small amounts are generally greater than 0 wt % to less than about 2 wt %, and can be in a range of 1–2 wt % of the formulation. The ballistic modifier is in fine particulate form and is generally of a pre-selected particle size, typically less than 1 micron such as 0.02 micron to 0.8 micron. The particle size of the ballistic modifier, and in particular $TiO_2$, can affect the plateau location observed with the present formulations.

The formulation can include, if desired, effective amounts of one or more co-oxidizers. In general, the amount which is included is in a range of 2–20% by weight of the formulation. Co-oxidizers suitable for use herein include ammonium nitrate (AN), cyclotetramethylene tetranitramine (HMX), cyclotrimethylene trinitramine (RDX), or CL-20 (also known as (2,4,6,8,10,12-hexanitro-2,4,6,8,10,12-hexaazatetracyclo[$5.5.0.0^{5,9}.0^{3,11}$]-dodecane and 2,4,6,8,10,12-hexanitrohexaazaisowurtzitane), or addition of coolants such as oxamide, dicyandiamide ("DCDA"), 5-amino tetrazole ("5-AT") or hydroxlammoniumbitetrazole amine ("HaBTA"). By preference these materials are anhydrous.

A suitable stabilizer can be selected by those skilled in the art. Suitable such stabilizers include N-methyl-p-nitroaniline ("MNA"). The amounts of stabilizer are generally low relative to the formulation, and the amount is typically selected as a small but stabilizing amount. Amounts as low as less than 1% may be used, such as 0.1% by weight.

Catalysts can be used in the preparation of the present formulations. An exemplary such catalyst is triphenyltin chloride ("TPTC"), although other catalysts can be suitably selected by those skilled in the art.

Selected non-metallized propellant formulations are contemplated herein. Such selected formulations may be deemed "reduced smoke" formulations, and generally contain a small but effective amount of a stability additive, such as zirconium carbide, instead of a powdered metal fuel. An amount of about 1% by weight or less is an example of a useful amount of zirconium carbide. Exemplary of these reduced smoke formulations are those based on an oxetane binder (poly-NMMO etc.) with at least one of TEGDN or BuNENA as a plasticizer, a stabilizer (such as MNA), bi-modal ammonium perchlorate (200 microns and 2.1 microns), refractory oxide ($TiO_2$) and curative (Desmodur N-100). In these exemplary formulations, the amounts of the ingredients can, for instance, be approximately 13.1 to 15.0% oxetane binder, 7.5 to 11%% plasticizer, 0.25% stabilizer, and inorganic oxidizer (70–74% solids) in selected coarse to fine weight ratios (such as, for instance, 58:42 or 53:47), and isocyanate-based curative (less than 2.5 wt %, such as less than 1 wt %).

In certain embodiments of the invention, the propellant can be metallized. That is, the propellant can include up to about 25 wt % of a powdered metal, such as in a range of about 5–20 wt %. In most applications, aluminum is the powdered metal of choice, and suitable particle sizes will be selected depending on the plateau ballistic properties desired. As an example, metal particles can be in a range of 80 microns to 130 microns.

The complete disclosures of U.S. Pat. No. 5,579,634 and of U.S. Pat. No. 5,334,270 concerning the formulations therein described and the character thereof are incorporated herein.

The formulations are suitably prepared to have a solids content in the range of approximately 65 wt %–85 wt %, and more particularly approximately 70 wt % to 78 wt %.

The present invention also contemplates a method for tailoring the performance of a solid rocket motor propellant such that the propellant exhibits a burn rate plateau over at least one pressure region. The method involves the steps of incorporating the bi-modal inorganic oxidizer ("AP") within the propellant, incorporating the selected refractory oxide within the propellant, wherein the propellant includes the plasticizer and oxetane-based binder.

Examples of plateau formulations are shown in FIGS. 1–6. The formulations can be tailored such that the plateaus fall in different pressure regions and at different burn rates.

Figure 2:
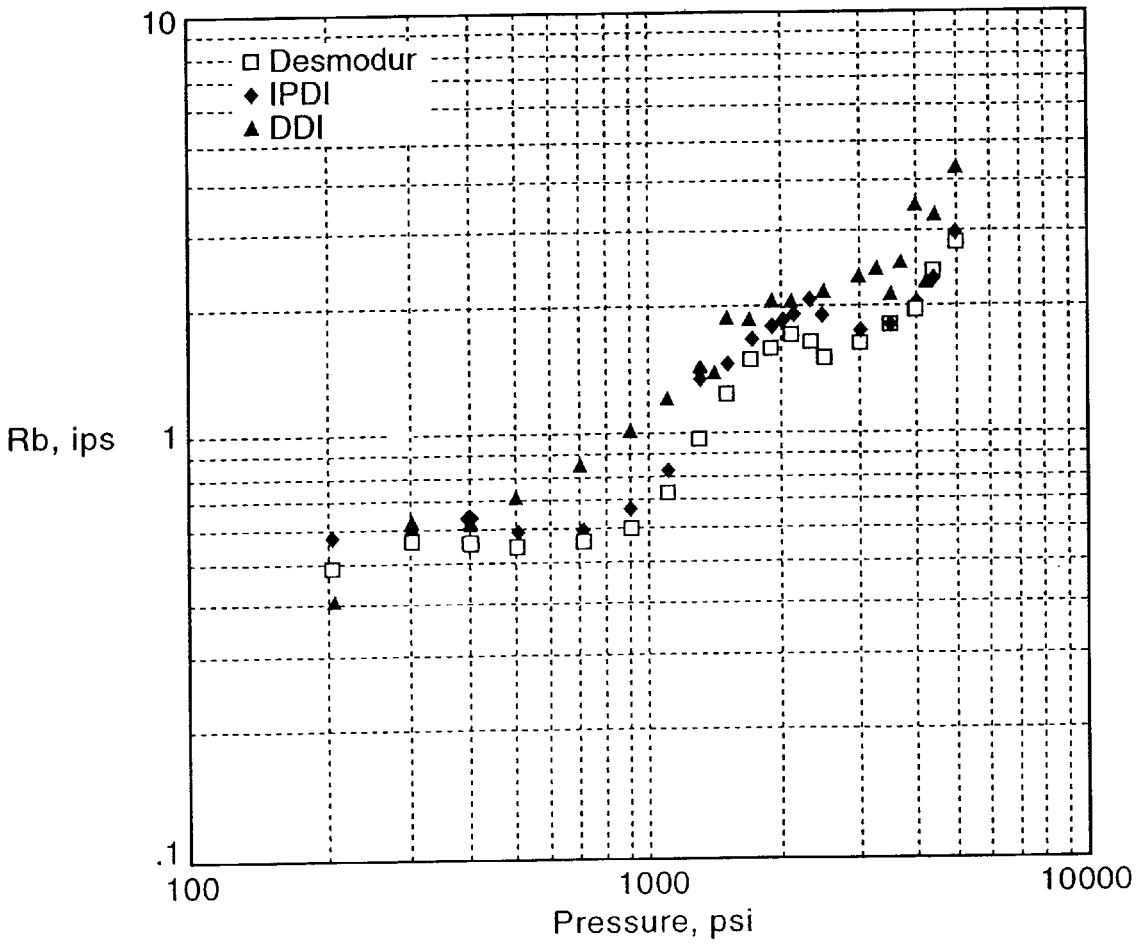
FIG. 2 shows the effect of different curatives on the ballistic properties of the propellant.

Examples of the NMMO formulations are shown in is FIGS. 1 and 2. The formulations are plasticized with TEGDN. Total solids for the formulations were 73%, with 200$\mu$:2u AP at a ratio of 53:47. All formulations contained a ballistic modifier (2% $TiO_2$), and 1% aluminium, and Desmodur N-100 as the curative. FIG. 1 shows the effect of varying plasticizer-to-polymer ratio. As shown in FIG. 1, the separation between the high-pressure plateau and the low-pressure plateau is much more pronounced at lower solid loading ranges. Also, the burn rate is increased and the plateau is slightly less defined at higher plasticizer to polymer (Pl/Po) ratios. FIG. 2 shows the effect of different curatives on the ballistic properties of the propellant. (The strands burned completely for each of the formulations represented in FIG. 2.) As shown in FIG. 2, the curative selection affects the plateau location and burn rates.

Figure 3:
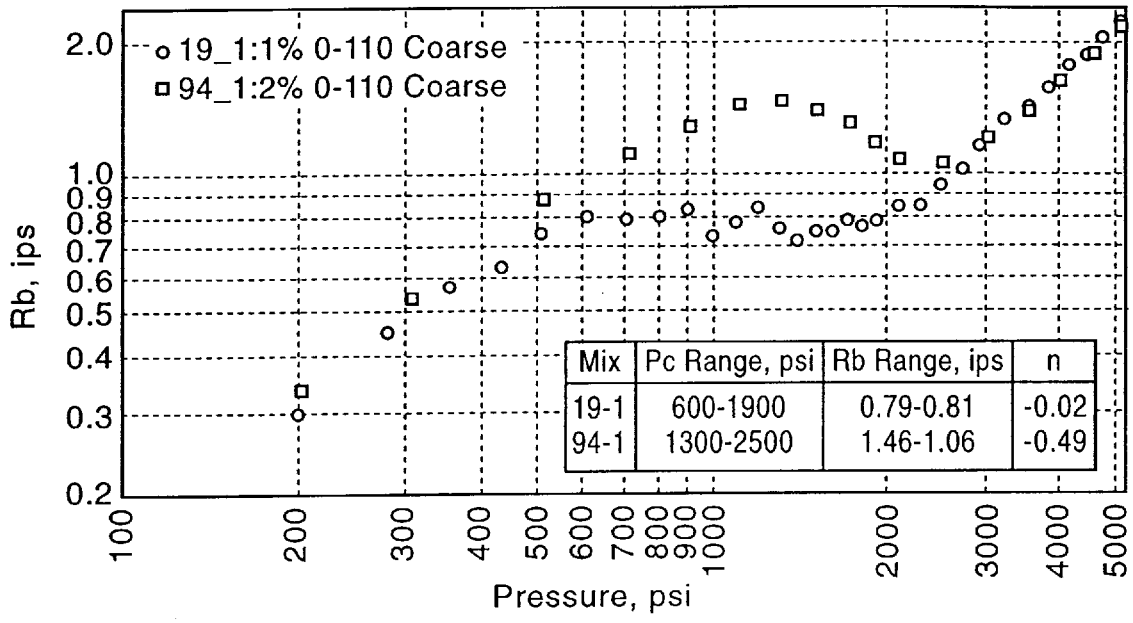
FIGS. 3 and 4 show the effect of $TiO_2$ concentration and particle size on the ballistic properties of the propellant containing a bi-modal ammonium perchlorate.
Figure 4:
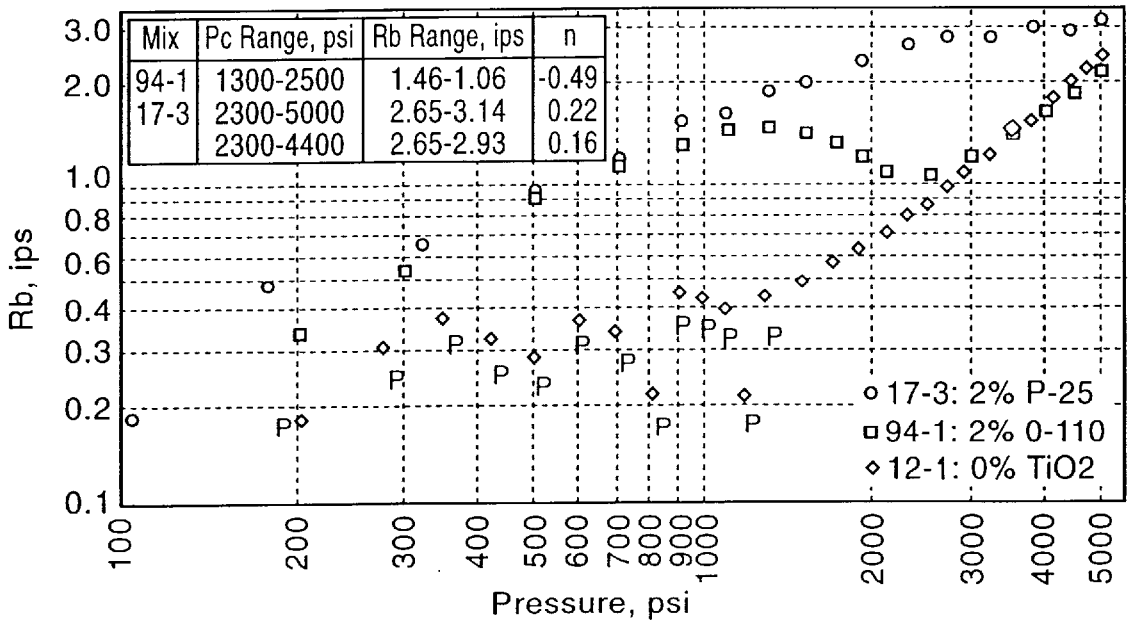
Figure 5:
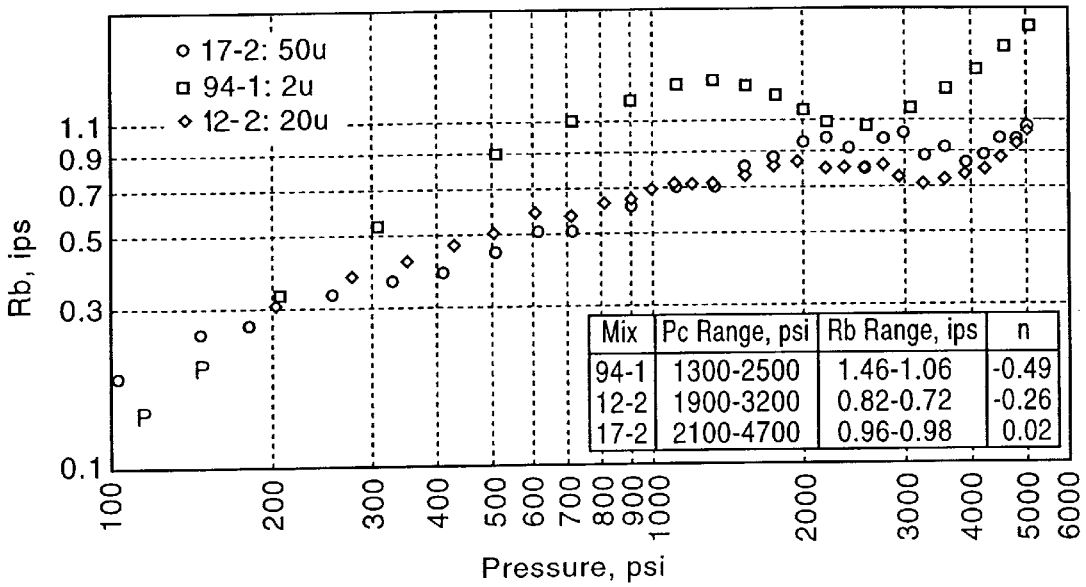
FIG. 5 shows the effect of changing the particle size in the ammonium perchlorate fine fraction while maintaining a selected AP coarse: AP fine ratio.

Examples of the AMMO formulations are shown in FIGS. 3, 4 and 5. These exemplary formulations were plasticized using BuNENA at a plasticizer-to-polymer ratio of 1.5. Total solids for the formulations were 75 wt %. FIGS. 3 and 4 show the effect of $TiO_2$ concentration and particle size on the ballistic properties of the propellant containing a bimodal of 200$\mu$:2u AP (53:47). FIG. 3 shows the effect of changing the particle size of the fine fraction of AP on the ballistic properties of the propellant with the coarse:fine ratio maintained at 53:47.

Figure 6:
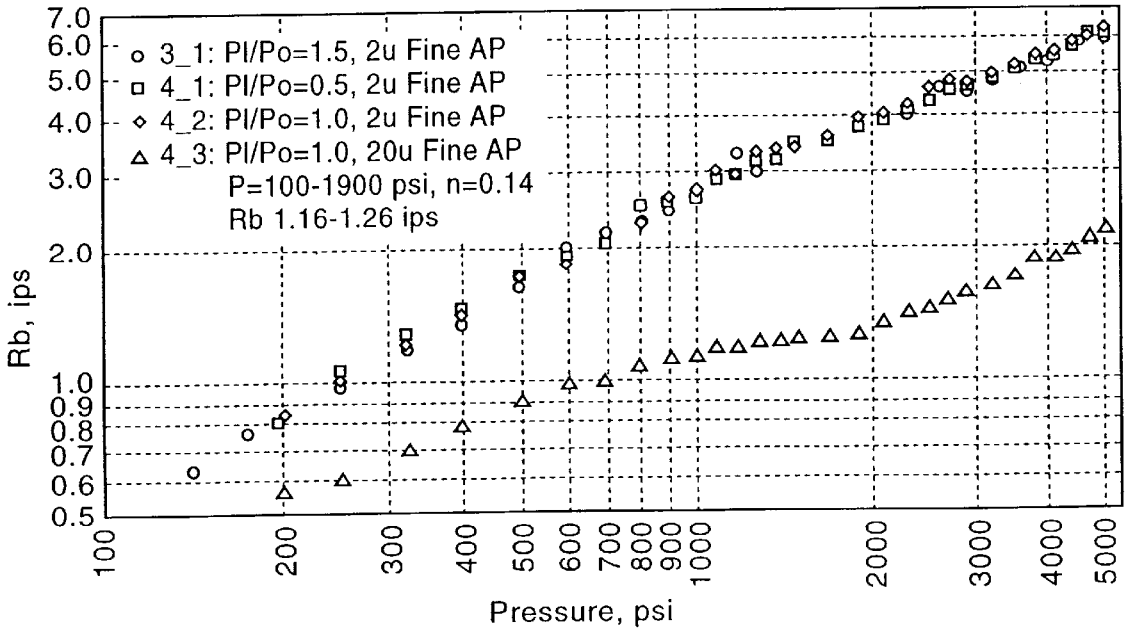
FIG. 6 relates to an example of a BAMO-AMMO formulation demonstrating the criticality of the fine particle sizes of the ammonium perchlorate.

An example of the BAMO-AMMO formulations is shown in FIG. 6. The formulation was plasticized using a GAP plasticizer at a plasticizer-to-polymer ratio of 1.0. Total solids are 75 wt %. The propellant contained 2 wt % $TiO_2$. By preference, the fine fraction of primary oxidizer, e.g., ammonium perchlorate, is no smaller than 20 um for good plateau ballistic properties with this energetic binder system.

A low binder liquefaction temperature may offer advantages. It is presently postulated, without intending to limit the present inventions, that a low binder liquefaction temperature promotes formation of melt layer(s) during combustion, and thus promotes plateau ballistic behavior.

Surprisingly, notwithstanding their tending to contribute towards a raised burn rate, the monopropellant combustion characteristics of the energetic binders in the present formulations do not preclude manifestation of the desired plateau ballistic properties.

One baseline NMMO formulation employed TEGDN plasticizer at a plasticizer/polymer ratio ($P_1/P_0$) of 0.5 and Desmodur N-100 (a polyisocyante curative from Mobay). In comparison to the AP/HTPB propellant, in the formulation according to the present invention the total solids were reduced from 88 wt % (HTPB-based propellant) to 73 wt %, the $P_1/P_0$ ratio could be increased to 0.7 with a coarse/fine ratio of ammonium perchlorate (53/47) and still exhibit good biplateau results. The $TiO_2$ additive level was maintained at 2% using the nominal 0.5 $^{\mu}$material. The AP coarse/fine ratio was adjusted downward from the 62/38 blend of 200$^{\mu}$/2$^{\mu}$sizes used in the HTPB binder.

Various effects of curative are unpredictably contrary to those observed of with a plateau propellant based on a non-energetic binder such as hydroxy terminated polybutadiene ("HTPB"). For instance with an NMMO binder, use of isophorone diisocyanate ("IPDI") increased burn rates slightly at low pressure and surprisingly improved the plateau definition at higher burn rate and pressure levels, compared to the results observed when DDI or Desmodur N-100 type diisocyanate curatives were used. For a propellant formulation in which NMMO was cured with dimeryl diisocyanate (DDI), the low pressure plateau was eliminated and the high pressure plateau tended to be obscured. This is the antithesis of the effects observed for DDI relative to IPDI in a propellant based on a plateau ballistic propellant based on a HTPB binder. In the plateau ballistic propellant based on HTPB, the use of DDI lowered the burn rates in a manner which created low pressure plateau while maintaining the definition of a high pressure plateau.

Figure 7:
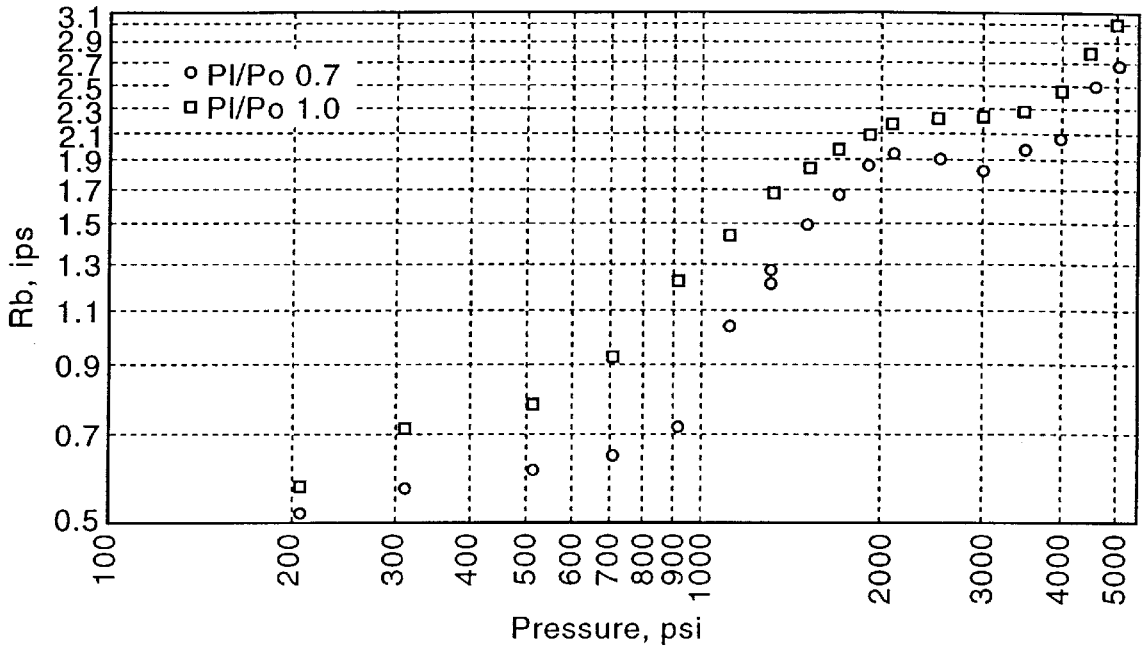
FIG. 7 depicts the effect of the plasticizer level in biplateau characteristics of a 75% total solids NMMO/TEGDN formulation (the effect of $P_1/P_0$ratio with the solids held constant).

The $P_1/P_0$ ratio should be selected consistent with the objects of the present invention. The present formulations can be suitably prepared to have a $P_1/P_0$ ratio in a range of about 0.5 to 3.0,although more particularly the ratio is in a range of about 0.5 to 2.0. The effect of $P_1/P_0$. ratio with the solids held constant is shown in FIG. 7. These formulations also contain stability additive (e.g. 1% aluminum) that contributes to $I_{sp}$. Higher $P_1/P_0$ ratios raise burn rates more at low pressure than at high pressure and the increases at low pressure are in such a way as to narrow the low exponent region. The high pressure plateaus are more like plateaus (zero exponent) than mesas (negative exponents). In these formulations "plateau" is being used as a generic term applicable to very low, zero and negative exponents. The formulation with $P_1/P_0$ of 0.7 yields an exponent of 0.1 between 200 and 700 psi, and an overall exponent of 0.1 (with a slight mesa) between 2000 and 4000 psi.

The AMMO binder system employed BuNENA plasticizer at a $P_1/P_0$ ratio of 1.5 and was cured with Desmodur N-100. Total solids was 75% including 1% aluminum. The $TiO_2$ (0.5$^{\mu}$) content was 2%. The 53/47 coarse/fine AP blend was capable of being processed with this formulation.

Figure 8:
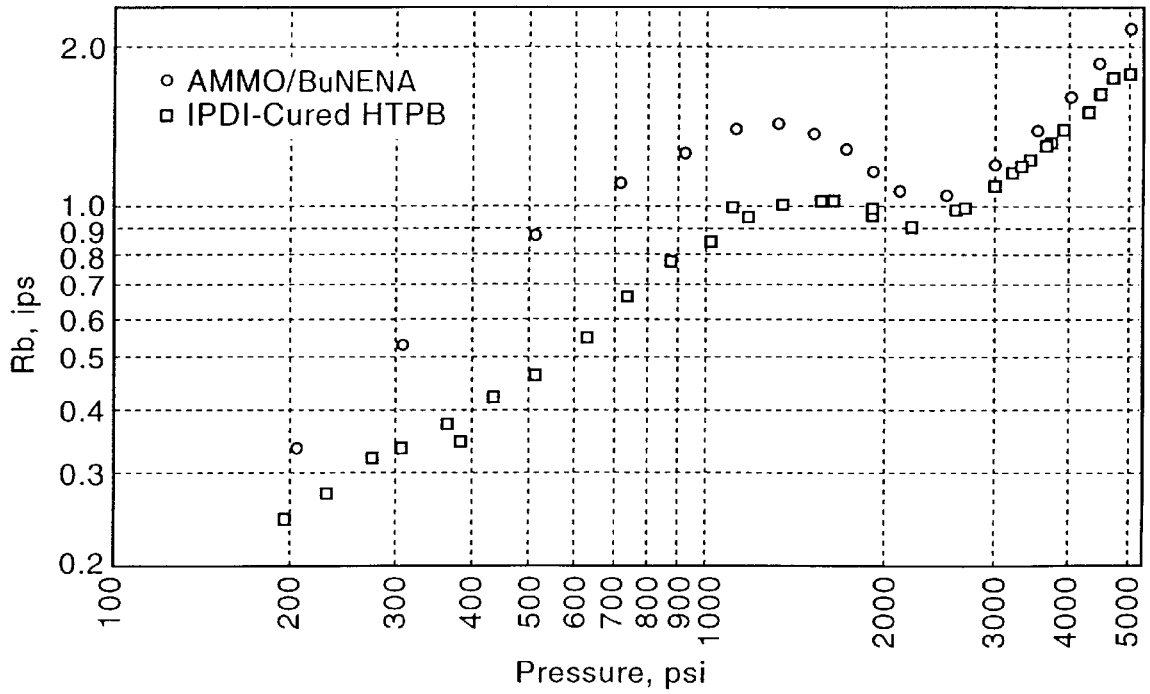
FIG. 8 depicts comparatively a present AMMO (plasticized) formulation versus a cured HTPB formulation.

Results are shown together with a comparable IPDI-cured HTPB formulation in FIG. 8. The energetic binder formulation yields higher burn raises and a more defined mesa. Comparing FIGS. 2 and 5, the difference in plateau characteristics between the NMMO and AMMO binder systems is analogous to that between the DDI-cured and IPDI-cured HTPB systems.

The effect of $TiO_2$ particle size was examined in the baseline AMMO/BuNENA formulation. Two sizes of $TiO_2$ were compared: The nominal 0.5$^{\mu}$particle size reported above, and a finer size of 0.02$^{\mu}$. The results are shown in FIG. 4, along with the formulation without $TiO_2$ ballistic modifier. The formulation without $TiO_2$ shows the suppressed burning, i.e. partial burnings in strands, at low-to-intermediate pressure. The finer particle size of $TiO_2$ delays the onset of the plateau region to higher pressure and higher burn rates than the coarse particle size of $TiO_2$.

In the HTPB plateau formulations, the 2% level of $TiO_2$ was found to produce plateaus with strong definitions; lower concentration caused the plateau to "wash out." For comparison purposes, concentrations of 1% have been considered in the AMMO/BuNENA formulations. In contrast to the results observed with the plateau ballistic propellant based on HTPB, in the AMMO/BuNENA based formulations, the definition of the plateau region did not diminish when only 1% of $TiO_2$ (fine particle size) was used. In the case of the coarse particle size $TiO_2$ the mesa behavior (negative exponent) seen at the 2% level decreases in strength, but the plateau region is still broad as seen in FIG. 5.

The baseline plateau formulations utilize 2 micron sized AP as the fine fraction of the blend. In HTPB systems, increasing the size of the fine AP fraction causes a loss in plateau behavior; while AP at 3.2 microns still produces plateau behavior, AP at 9 microns did not. The effect of changing the particle size of the fine AP fraction was examined in the 75% solids AMMO/BuNENA baseline formulation, $P_1/P_0$=1.5, 2% $TiO_2$ (0.5$^{\mu}$). The coarse/fine ratio was maintained at 53:47. Particle sizes of 20 microns and 50 microns were examined. Results are shown in FIG. 5. The capability of the present formulations to be combusted so as to have a plateau with the larger fine AP sizes offers additional tailoring flexibility for more general purposes/applications not heretofore practically available using conventional HTPB-based propellants.

Results have been obtained with the present invention using a BAMO-AMMO energetic binder system. In this embodiment, the BAMO-AMMO binder was plasticized at a pre-targeted $P_1/P_0$ weight ratio of 1.5:1 with ammonium perchlorate (fine particulates), and other additives. Other additives included, for instance, ballistic agents and energetic stabilizers. An exemplary formulation contained BAMO-AMMO plasticized with GAP at a suitable $P_1/P_0$ ratio at, for instance, a total solids content of 75 wt %; with 72 wt % inorganic oxidizer (e.g. ammonium perchlorate), a small but effective among of ballastic additive (e.g. 2 wt % $TiO_2$), and a small but effective amount of a suitable energetic stabilizer (e.g. 1 wt % aluminum). In one such exemplary formulation, good results were obtained using a distribution of inorganic oxidizer (ammonium perchlorate) of 200 u oxidizer particles to 20 u oxidizer particles of 53/47. The energetic substituents in the binder are solely azide groups when a GAP plasticizer is used.

Several formulation variations are within the scope of the present invention. One embodiment combined changes in total solids and coarse/fine ratio. Total solids were increased to 80%, accompanied by a coarse/fine ratio of 55/45. In a second embodiment, variation of plasticizer content lowered the $P_1/P_0$ ratio to 1.0 and 0.5. In a third embodiment, the fine AP size was increased to 20 microns with $P_1/P_0$ =1.0 .

Evaluation of present formulations in 7-inch tactical motors indicates that the formulations of the present invention provide the desired increase in delivered impulse.

Isp densities (theoretical) are, in principle, surprisingly better than obtainable with conventional HTPB propellants, and these surprising results are also obtainable at significantly lower solid loadings.

The present formulations are useful for use in tactical devices such as in air-to-air tactical systems, ship board tactical systems, divert propellant applications, and, for instance, ground based tactical systems. The present formulations are useful in air-to-air missiles and propulsive warhead delivery systems, including armor penetrating weapons.

EXAMPLES

The present invention is described further with respect to the following non-limiting Examples.

The polymer, plasticizer and stabilizer are added to warm (120–135° F.) mix bowl (vertical Baker-Perkins mixer), and blended for 5 minutes or until dispersed. A combustion stabilizer (e.g. aluminum) is added and dispersed. The selected inorganic oxidizer (e.g. ammonium perchlorate, "AP") is added in several increments, coarse material first. The mix cycles are run under vacuum and the total mix time is approximately 60 minutes. $TiO_2$ is added and mixed under vacuum for 15 minutes. Curative and cure catalyst are added and mixed under vacuum for 20 minutes. Samples are cast under vacuum and cured at 120–135° F.

The exemplary formulations are listed in Table I. Table I also includes some of the data obtained from testing these formulations.

TABLE I

| | Example 1 | Example 2 | Example 3 | Example 4 | Example 5 |
|---|---|---|---|---|---|
| Polymer | NMMO 14.86% | NMMO 15.13% | AMMO 8.97% | BAMO-AMMO 11.88% | BAMO-AMMO 9.55% |
| Plast. | TEGDN 11.01% | TEGDN 11.01% | BuNENA 14.84% | GAP-P | BuNENA 14.85% |
| Stabilizer | MNA 0.25% | MNA 0.25% | MNA 0.25% | — | — |
| Al | 1% | 1% | 1% | 1% | 1% |
| AP (200u) | 37.10% | 37.10% | 38.69% | 38.16% | 38.16% |
| AP (50u) | — | — | — | — | 33.84% |
| AP (20u) | — | — | — | 33.84% | — |
| AP (2u) | 32.90% | 32.90% | 34.31% | — | — |
| $TiO_2$ | 2.00% | 2.00% | 1.00% | 2.00% | 2.00% |
| Curative | Desmodur 0.87% | IPDI 0.60% | Desmodur 0.93% | Desmodur 0.74% | Desmodur |
| TPTC Catalyst | 0.01% | 0.01% | 0.01% | 0.01% | 0.01% |
| — | — | — | — | — | — |
| Ballistic Properties | | | | | |
| Plateau Region, psi | 200–500 | 400–700 | 600–1900 | 1100–1900 | 1900–3500 |
| Exponent | 0.17 | −0.20 | −0.02 | 0.14 | −0.05 |
| Rb, ips at Plateau | 0.52–0.60 | 0.66–0.59 | 0.81–0.79 | 1.16–1.26 | 0.98–0.95 |
| Plateau Region, psi | 2100–4000 | 2300–3000 | | | |
| Exponent | 0.10 | −0.68 | | | |
| Rb, ips at Plateau | 1.93–2.06 | 2.09–1.75 | | | |

What is claimed is:

1. An energetic solid rocket motor propellant having one or more plateau regions of low operating pressure exponent, said propellant being formulated from ingredients comprising:

at least one energetic oxetane homopolymer, copolymer, or terpolymer;

an effective amount of at least one plasticizer;

at least one inorganic oxidizer in at least two discrete particle size ranges; and at least one refractory oxide burn rate modifier.

2. An energetic solid rocket motor propellant as defined in claim 1, wherein the refractory oxide is at least one member selected from the group consisting of titanium dioxide, zirconium dioxide, alumina, tin dioxide, and silica.

3. An energetic solid rocket motor propellant as defined in claim 2, wherein the refractory oxide is titanium dioxide.

4. An energetic solid rocket motor propellant as defined in claim 1, wherein the refractory oxide is present in a concentration of from approximately 0.2 wt % to approximately 4.0 wt %.

5. An energetic solid rocket motor propellant as defined in claim 1, wherein the refractory oxide is present in a concentration of from approximately 1.0 wt % to approximately 2.0 wt %.

6. An energetic solid rocket motor propellant as defined in claim 1, wherein the energetic polyoxetane is at least one member selected from the group consisting of poly-NMMO, poly-AMMO, poly-BAMO-AMMO, and blends, copolymers, and terpolymers thereof.

7. An energetic solid rocket motor propellant as defined in claim 6, wherein the energetic polyoxetane is blended or polymerized with one or more members selected from the group consisting of poly-DMO (poly-3,3-dimethyal oxetane), poly-EMO (poly-3,3-bis(ethoxymethyl)oxetane), poly-BCMO (poly-3,3-bis(chloromethyl)oxetane), poly-BMMO (poly-3,3-bis(methoxymethyl)oxetane), poly-BFMO (poly-3,3-bis(fluoromethyl)oxetane), poly-HMMO (poly-3-hydroxymethyl-3-methyloxetane), poly-BAOMO (poly-3,3-bis(hydroxymethyl)oxetane), poly-OMMO (poly-3-octoxymethyl-3-methyloxetane), poly-BMEMO (poly-3,3-bis(methoxyethoxymethyl)oxetane), poly-CMMO (poly-3-chloromethyl-3-methyloxetane), poly-AMMO (poly-3-azidomethyl-3-methyloxetane), poly-BIMO (poly-3,3-bis (iodomethyl)oxetane, poly-IMMO (poly-3-iodomethyl-3-methyloxetane), poly-PMMO (poly-3-propynomethylmethyloxetane), poly-BNMO (poly-3,3-bis (nitratomethyl)oxetane), poly-NMMO (poly-3-nitratomethyl-3-methyloxetane), poly-BMNAMO (poly-3,3-bis(methylnitraminomethyl)oxetane), poly-MNAMMO (poly-3-methylnitraminomethyl-3-methyloxetane), and poly-BAMO (poly-3,3-bis(azidomethyl)oxetane).

8. An energetic solid rocket motor propellant as defined in claim 1, wherein the plasticizer is at least one energetic plasticizer selected from the group consisting of nitrate esters, azido plasticizers, and nitrato/nitramino plasticizers.

9. An energetic solid rocket motor propellant as defined in claim 8, wherein the plasticizer is at least one member selected from the group consisting of nitroglycerin, ethyleneglycol dinitrate, diethyleneglycol dinitrate, triethyleneglycol dinitrate ("TEGDN"), polyethyleneglycol dinitrate, butanetriol trinitrate, trimethylolethane trinitrate, propyleneglycol dinitrate, ethylenediamine dinitrate, n-butyl-2-nitratoethyl-nitramine ("BuNENA"), methyl-2-nitratoethyl-nitramine, ethyl-2-nitratoethyl-nitramine, dinitroxy-diethylnitramine, and glycidyl azide plasticizer.

10. An energetic solid rocket motor propellant as defined in claim 1, further comprising a stabilizer.

11. A rocket motor comprising a solid propellant having one or more plateau regions of low operating pressure exponent, said propellant being formulated from ingredients comprising:

at least one energetic oxetane homopolymer, copolymer, or terpolymer;

an effective amount of at least one plasticizer;

at least one inorganic oxidizer in at least two discrete particle size ranges; and at least one refractory oxide burn rate modifier.

12. A rocket motor as defined in claim 11, wherein the refractory oxide is at least one member selected from the group consisting of titanium dioxide, zirconium dioxide, alumina, tin dioxide, and silica.

13. A rocket motor as defined in claim 12, wherein the refractory oxide is titanium dioxide.

14. A rocket motor as defined in claim 11, wherein the refractory oxide is present in a concentration of from approximately 0.2 wt % to approximately 4.0 wt %.

15. A rocket motor as defined in claim 11, wherein the refractory oxide is present in a concentration of from approximately 1.0 wt % to approximately 2.0 wt %.

16. A rocket motor as defined in claim 11, wherein the energetic polyoxetane is at least one member selected from the group consisting of poly-NMMO, poly-AMMO, poly-BAMO-AMMO, and blends, copolymers, and terpolymers thereof.

17. A rocket motor as defined in claim 16, wherein the energetic polyoxetane is blended or polymerized with one or more members selected from the group consisting of poly-DMO (poly-3,3-dimethyal oxetane), poly-EMO (poly-3,3-bis(ethoxymethyl)oxetane), poly-BCMO (poly-3,3-bis (chloromethyl)oxetane), poly-BMMO (poly-3,3-bis (methoxymethyl)oxetane), poly-BFMO (poly-3,3-bis (fluoromethyl)oxetane), poly-HMMO (poly-3-hydroxymethyl-3-methyloxetane), poly-BAOMO (poly-3,3-bis(hydroxymethyl)oxetane), poly-OMMO (poly-3-octoxymethyl-3-methyloxetane), poly-BMEMO (poly-3,3-bis(methoxyethoxymethyl)oxetane), poly-CMMO (poly-3-chloromethyl-3-methyloxetane), poly-AMMO (poly-3-azidomethyl-3-methyloxetane), poly-BIMO (poly-3,3-bis (iodomethyl)oxetane, poly-IMMO (poly-3-iodomethyl-3-methyloxetane), poly-PMMO (poly-3-propynomethylmethyloxetane), poly-BNMO (poly-3,3-bis (nitratomethyl)oxetane), poly-NMMO (poly-3-nitratomethyl-3-methyloxetane), poly-BMNAMO (poly-3,3-bis(methylnitraminomethyl)oxetane), poly-MNAMMO (poly-3-methylnitraminomethyl-3-methyloxetane), and poly-BAMO (poly-3,3-bis(azidomethyl)oxetane).

18. A rocket motor as defined in claim 11, wherein the plasticizer is at least one energetic plasticizer selected from the group consisting of nitrate esters, azido plasticizers, and nitrato/nitramino plasticizers.

19. A rocket motor as defined in claim 18, wherein the plasticizer is at least one member selected from the group consisting of nitroglycerin, ethyleneglycol dinitrate, diethyleneglycol dinitrate, triethyleneglycol dinitrate ("TEGDN"), polyethyleneglycol dinitrate, butanetriol trinitrate, trimethylolethane trinitrate, propyleneglycol dinitrate, ethylenediamine dinitrate, n-butyl-2-nitratoethyl-nitramine ("BuNENA"), methyl-2-nitratoethyl-nitramine, ethyl-2-nitratoethyl-nitramine, dinitroxy-diethyl-nitramine, and glycidyl azide plasticizer.

20. A rocket motor as defined in claim 11, further comprising a stabilizer.

* * * * *